US008801160B2

(12) United States Patent
Matsuo et al.

(10) Patent No.: US 8,801,160 B2
(45) Date of Patent: Aug. 12, 2014

(54) INK CARTRIDGE AND PRINTER

(75) Inventors: Keisuke Matsuo, Yokohama (JP); Hiroki Hayashi, Kawasaki (JP); Kenta Udagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/110,821

(22) Filed: May 18, 2011

(65) Prior Publication Data

US 2011/0285798 A1 Nov. 24, 2011

(30) Foreign Application Priority Data

May 21, 2010 (JP) ..... 2010-117252

(51) Int. Cl.
*B41J 2/175* (2006.01)

(52) U.S. Cl.
USPC ..... 347/86

(58) Field of Classification Search
USPC ..... 347/86
See application file for complete search history.

(56) References Cited

U.S. PATENT DOCUMENTS

| | | | | |
|---|---|---|---|---|
| 7,093,710 | B2 * | 8/2006 | Shimizu et al. | 206/213.1 |
| 2003/0058322 | A1 | 3/2003 | Suzuki | |
| 2005/0237368 | A1 | 10/2005 | Matsumoto | |
| 2005/0243149 | A1 * | 11/2005 | Matsumoto | 347/86 |
| 2007/0030322 | A1 * | 2/2007 | Lee et al. | 347/88 |
| 2007/0052768 | A1 * | 3/2007 | Ohashi et al. | 347/85 |
| 2007/0052769 | A1 * | 3/2007 | Kubo et al. | 347/85 |
| 2007/0263052 | A1 | 11/2007 | Iijima | |
| 2008/0273066 | A1 * | 11/2008 | Hiroki et al. | 347/85 |
| 2009/0289972 | A1 * | 11/2009 | Iino | 347/7 |
| 2010/0172204 | A1 * | 7/2010 | Okito et al. | 366/343 |

FOREIGN PATENT DOCUMENTS

| | | | | |
|---|---|---|---|---|
| CN | 1666876 | A | 9/2005 | |
| CN | 1935519 | A | 3/2007 | |
| EP | 1854633 | A2 | 11/2007 | |
| JP | 2005-66520 | A | 3/2005 | |
| JP | 2005-066520 | A | 3/2005 | |
| JP | 2005066520 | A * | 3/2005 | B05C 11/10 |
| JP | 2006-044153 | A | 2/2006 | |
| JP | 2007-118295 | A | 5/2007 | |
| JP | 2007-296644 | A | 11/2007 | |
| JP | 2007296644 | A * | 11/2007 | |

* cited by examiner

*Primary Examiner* — Matthew Luu
*Assistant Examiner* — Patrick King
(74) *Attorney, Agent, or Firm* — Canon USA Inc IP Division

(57) ABSTRACT

An ink cartridge includes an ink storage bag, a spout for ink supply and an agitation member individually attached to the ink storage bag, and a cartridge case containing the ink storage bag. The agitation member includes an agitation portion arranged in the ink storage bag and configured to agitate ink, and an operation portion connected to the agitation portion, positioned outside the ink storage bag, and configured to operate the agitation portion. The spout and the operation portion of the agitation member are arranged to one side of the cartridge case, the spout is fixed to the cartridge case, the ink storage bag is extended toward the other side of the cartridge case opposite to the one side thereof, and the ink storage bag has a free end without being fixed to the cartridge case.

6 Claims, 11 Drawing Sheets

INK CARTRIDGE AND PRINTER

BACKGROUND OF THE INVENTION

1. Field of the Invention

The present invention relates to an ink cartridge (ink tank) configured to store ink (e.g., pigment ink) having particles of a color material that are easily precipitated, and in particular, to an ink cartridge having ink agitation unit, and a printer on which the ink cartridge can be mounted.

2. Description of the Related Art

Conventionally, ink used for an inkjet printer includes dye ink using dye for a color material and pigment ink using pigment for the color material.

A printed matter using the pigment ink has high weathering resistance or high water resistance. On the other hand, the pigment ink has a problem of an uneven density in printing to be solved. The phenomenon may occur at the start time of using new ink or when the ink is not used for a relatively long time as particles of the pigment are easily precipitated in the ink, and a pigment density becomes lower at an upper portion of the ink cartridge and the pigment density becomes higher at a lower portion of the ink cartridge.

As a countermeasure therefor, Japanese Patent Application Laid-Open No. 2005-66520 discusses an ink tank in which an ink supply portion is arranged to one edge of an envelope-shaped ink storage bag, an agitation member is arranged to another edge opposite to the one edge to be operated with external power, and an operation portion for operating the agitation member is externally extended to the ink storage bag. By operating the operation portion, a joint portion, at which the agitation member and the edge of the ink storage bag are joined, functions as a fulcrum point. Further, the agitation member inserted to the ink storage bag is moved to agitate the pigment ink.

With the configuration discussed in Japanese Patent Application Laid-Open No. 2005-66520, a tank casing is provided with an ink supply portion arranged on the edge of the ink storage bag opposite to the edge on which the agitation member is arranged. As a consequence, the movement of the ink storage bag is regulated (limited) on the ink supply unit side. In particular, when the amount of ink in the ink storage bag becomes small and the ink storage bag is reduced in volume to become flattened, the operation of the agitation member in the ink storage bag is inhibited, and an agitation effect is deteriorated.

When manufacturing an ink storage bag having a spout and an agitation member on opposite edges, the spout needs to be attached to one opening of a cylindrical-shaped film and the agitation member needs to be attached to the other opening. Therefore, an attachment process becomes complicated because the attachment of the spout and the agitation member is performed at opposite positions, respectively. The possibility is high to generate undesirable creases or crimping due to the attachment. Consequently, the possibility of an adverse effect such as leakage of the ink is increased.

In addition, the ink supply unit is generally arranged at the back of a tank attachment operation range. An agitation mechanism for operating the agitation member is arranged in front of the tank attachment operation range. The printer configuration is complicated and is increased in scale.

SUMMARY OF THE INVENTION

The present invention is directed to an ink cartridge and a printer capable of one or more of: inhibiting the deterioration in agitation effect of ink even if the amount of ink in an ink storage bag is small; reducing the complexity of cartridge manufacture; reducing the failure rate of ink cartridges (e.g. reducing incidence of leaks); reducing printer complexity and reducing printer size.

According to an aspect of the present invention, an ink cartridge includes a flexible ink storage bag, a spout for ink supply attached to the storage bag, an agitation member attached to the ink storage bag, a case containing the ink storage bag, wherein the agitation member includes an agitation portion, arranged in the ink storage bag and configured to agitate ink, and an operation portion, connected to the agitation portion, positioned outside the ink storage bag and configured to operate the agitation portion, and wherein the spout and the operation portion are arranged on the same side of the case.

According to another aspect of the present invention, a printer includes a recording head configured to discharge ink droplets to a recording sheet and record an image on the recording sheet, and an ink cartridge attachment portion, to which an ink cartridge can be detachably attached, extending from an opening to a back end, the ink cartridge attachment portion may comprise an ink supply unit configured to supply ink to the recording head from an attached ink cartridge and an agitation-member drive unit configured to engage with and drive an agitation member of such an attached ink cartridge, wherein the ink supply unit and the agitation-member drive unit are both arranged at the back end of the ink cartridge attachment portion.

According to the present invention, if the amount of ink in the ink storage bag is small, an agitation effect of the ink is not deteriorated, the complicity and adverse effect at manufacturing time of the ink tank are suppressed, and the printer configuration is reduced in size.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Herein, an ink cartridge comprising a flexible bag containing pigment ink and a rigid case surrounding the flexible bag is given as an example of an ink cartridge. However, the liquid is not limited to pigment ink, and any liquid with physical property for easy precipitation can be used.

Figure 1:
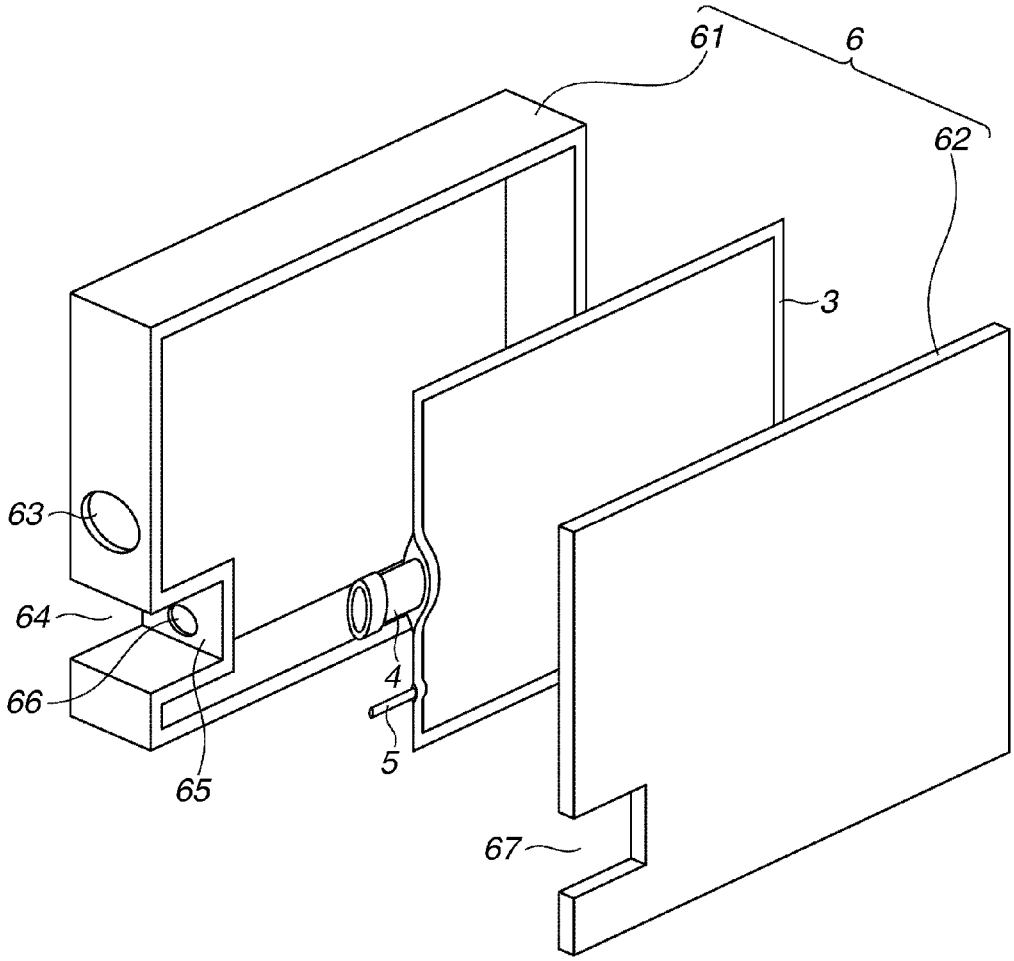
FIG. 1 illustrates an exploded schematic view illustrating a configuration of an ink cartridge according to an exemplary embodiment of the present invention.
Figure 2A:
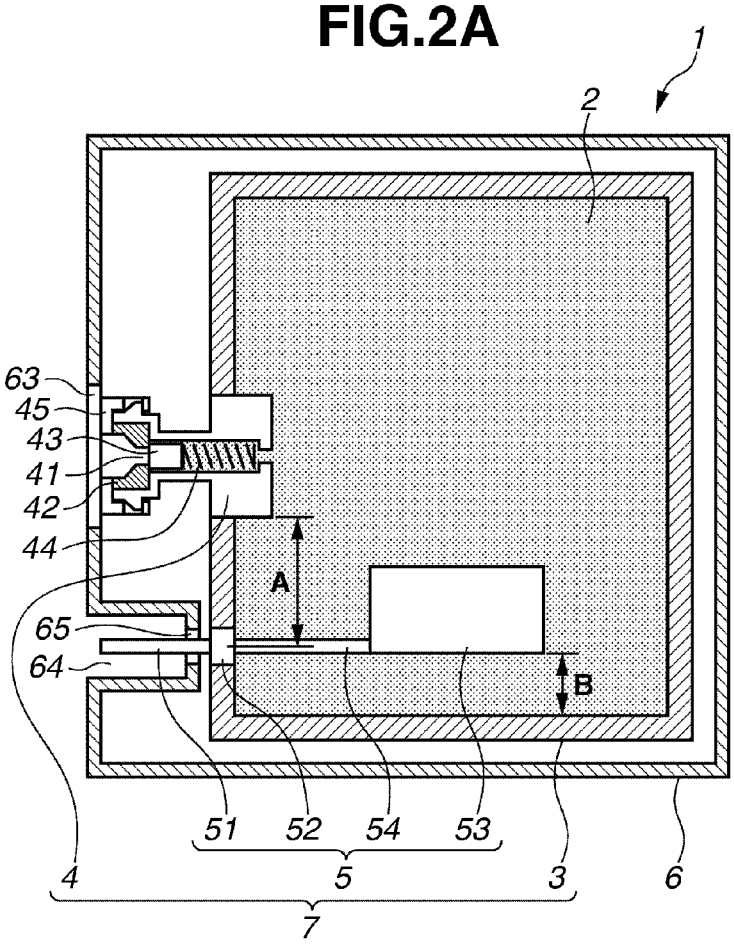
FIGS. 2A to 2C are cross-sectional schematic views illustrating a state at start time of using the ink cartridge according to the exemplary embodiment of the present invention.
Figure 2B:
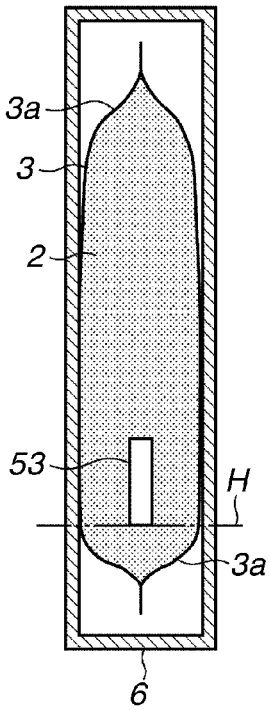
Figure 2C:
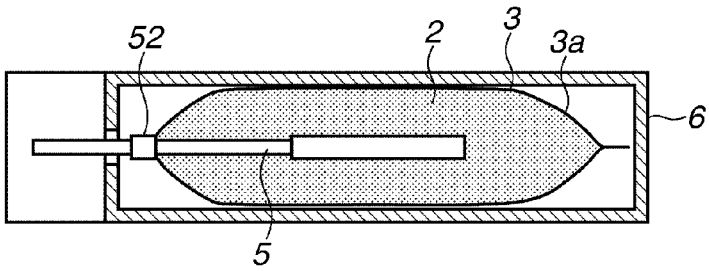

FIG. 1 is an exploded schematic view illustrating a configuration of the ink cartridge according to the present exemplary embodiment. FIGS. 2A to 2C are schematic diagrams illustrating a state at start time of using the ink cartridge according to the present exemplary embodiment. In particular, FIG. 2A illustrates a cross-section when viewing the ink cartridge from the side in the orientation in which the ink cartridge is attached to an ink cartridge attachment portion 103, 103*a*, 103*c* (See FIG. 11) of a printer.

More specifically, FIG. 2A illustrates a cross-section parallel with a side surface with the maximum area of the ink cartridge, passing through an ink supply unit. Further, FIG. 2B illustrates a cross-section parallel with a side surface having an ink supply port of the ink cartridge, passing through an agitation portion. Furthermore, FIG. 2C illustrates a cross-section parallel with a bottom surface of a cartridge casing, passing through the agitation portion.

As illustrated in FIGS. 1 and 2A to 2C, an ink cartridge 1 according to the present exemplary embodiment includes an ink storage bag 3 configured to store ink 2 such as pigment ink that is easily precipitated when it is left for a long time, a spout 4 for ink supply, and an agitation member 5 attached to the ink storage bag 3, and a cartridge case 6 configured to fix the spout 4, and to contain the ink storage bag 3.

In the present exemplary embodiment, the spout 4 and the agitation member 5 when connected to the ink storage bag 3 are referred to as an ink storage bag unit 7. Both the spout 4 and the agitation member 5 are attached to the same edge of the ink storage bag 3 in the attitude (orientation) for attaching the ink cartridge 1, illustrated in FIG. 2A, to the printer. In the attitude for attaching the ink cartridge to the printer (so the orientation for attaching the ink cartridge to the printer), the spout 4 is in the center of the edge on the side of the ink storage bag 3, and the agitation member 5 is below the spout 4.

The ink storage bag 3 is made of a flexible film member. Two rectangular pieces of film are first overlapped, and the edges of three sides thereof are thermally welded to form an envelope-shaped bag (or rectangular-shaped bag), and the ink storage bag 3 is thus produced. Obviously, the envelope-shaped bag may be produced with a method other than this.

The spout 4 and the agitation member 5 are inserted into an opening at the remaining one side that is not welded. The film edges on the remaining one side are thermally welded, thereby forming the ink storage bag unit 7.

A film member forming the ink storage bag 3 of the present embodiment is structured by sequentially laminating a polyethylene terephthalate layer (outermost layer), adhesion layer, aluminum alloy layer, adhesion layer, nylon layer, adhesion layer, and polypropylene layer (innermost layer).

The aluminum alloy layer shields against transmission of gas into the ink storage bag 3, and also prevents vaporization of the ink. Further, the nylon layer enables high tolerance against denting (deforming) the film caused by bending or friction. An inner layer of the ink storage bag 3 mainly contains polypropylene, and has high tolerance against the ink.

The spout 4 is used for arranging an ink supply port 41 for externally supplying the ink 2 to the ink storage bag unit 7. A sealing member 42, a valve 43, and a spring 44 are built in the ink supply port 41 arranged to the spout 4.

A valve 43 is arranged to be urged to the sealing member 42 with the spring 44. The sealing member 42 is assembled to the spout 4 with a cap 45 for preventing it falling off.

The sealing member 42 has a ring shape having an opening in the center thereof. The opening is covered by abutting the valve 43 thereto. Further, the outer circumference of the sealing member 42 is attached firmly to the inner circumference of the spout 4, thereby assuring the airtightness between the sealing member 42 and the spout 4.

At the circumference on the inner side (so oriented towards the ink storage bag 3) of the opening of the sealing member 42 a lip-shaped projection is structured to surround the opening, as a configuration for improving the adhesiveness when the valve 43 is abutted to the sealing member 42.

The outer circumference of the sealing member 42 comes into contact with the spout 4. Further, the valve 43 is urged to the sealing member 42, thereby shutting off the space in/out-of the ink storage bag unit 7.

The spout 4 is configured with a rigid material. The valve 43 and the sealing member 42 are configured with a flexible material, e.g., a rubber member such as butyl rubber, or a thermoplastic resin member such as elastomer.

The agitation member 5 agitates the ink 2, which is easily precipitated, in the ink storage bag 3. Specifically, the agitation member 5 includes an operation portion 51 having one end extended to the outside of the ink storage bag 3, for external agitation operation, an agitation-member welding portion 52 that is welded to an edge of one side of the ink storage bag 3, an agitation portion 53 that is arranged in the ink storage bag 3 on the other end side of the operation portion 51 and agitates the ink 2, and a transmission unit (portion) 54 that connects the operation portion 51 to the agitation portion 53, and transmits external operation force to the agitation portion 53.

The agitation portion 53 is plate-shaped with a certain area to effectively agitate the precipitated ink 2. Further, at the time of using the ink cartridge 1, the agitation portion 53 is arranged near the bottom portion of the ink storage bag 3 containing the precipitated ink 2.

The transmission unit 54 is bar-shaped with a small area of the cross-section and extends to the agitation portion 53. As a consequence, the transmission unit 54 can be bent with elastic force, and the entire surface of the agitation portion 53 can be pressed to the inner surface of the ink storage bag 3, thereby effectively agitating the ink 2. That is, in a process for pressing the entire surface of the agitation portion 53 to the inner surface of the ink storage bag 3, the ink between the surface of the agitation portion 53 and the inner surface of the ink storage bag 3 is pressed and pulled, thereby generating an ink flow. As a consequence, the ink therearound is agitated.

Next, assembling of the ink storage bag unit 7 to the cartridge case 6 will be described.

The cartridge case 6 is (flat) parallelepiped-box-shaped (preferably having a rectangular parallelepiped shape), with a facing surface larger than the maximum facing surface of the ink storage bag unit 7 (so the ink storage bag unit fits within the case). Further, the cartridge case 6 includes an ink storage bag containing member 61 having three walls defining a cavity (concave portion), that contains the ink storage bag unit 7, and a cartridge cover 62 that forms the fourth wall of the case and covers the opening of the cavity (see FIG. 1).

The ink storage bag containing member 61 has a fixing portion (not illustrated) into which a projected portion of the spout 4 of the ink storage bag unit 7 can be fitted. The spout 4 is fitted into the ink storage bag containing member 61, thereby fixing the ink storage bag unit 7 to the ink storage bag containing member 61.

An opening 63 is arranged at the position corresponding to the ink supply port 41, formed by the spout 4, on the side wall of the ink storage bag containing member 61.

An indented (concave) portion 64, extending inwards towards the inside of the cartridge case 6, is formed on the side wall of the ink storage bag containing member 61 which has the opening 63. An opening 66, for the agitation member, is formed on a surface 65 at a deep point of the concave portion 64 to enable the operation portion 51 of the agitation member 5 to project outside of the cartridge case 6. A notch 67, corresponding to the shape of the concave portion 64, is formed in the cartridge cover 62.

The concave portion of the ink storage bag containing member 61 contains the ink storage bag unit 7. A fixing unit (not illustrated) fixes the spout 4. Then, the cartridge cover 62 covers an opening of the concave portion of the ink storage bag containing member 61.

An operation is described according to the present exemplary embodiment.

FIGS. 3A to 3H illustrate states of operating the agitation member 5, viewed in the cross-section illustrated in FIG. 2C. Arrows near the operation portion 51 in the agitation member 5 in FIGS. 3A to 3H illustrate operation directions of the operation portion 51.

The operation portion 51 is reciprocated, externally of the cartridge case 6. Then, in the agitation member 5, with the agitation-member welding portion 52 as a fulcrum point, the agitation portion 53 is operated with an inverse phase of the operation portion 51 (so the agitation portion 53 moves in an opposite direction to the movement of the operation portion 51).

Figure 3A:
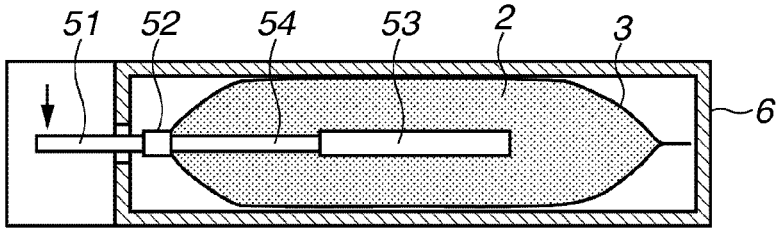
FIGS. 3A to 3H are cross-sectional views sequentially illustrating states of operating an agitation member, viewed in the cross-sectional view in FIG. 2C.
Figure 3B:
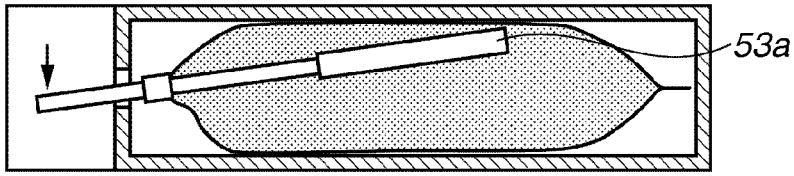

Further, operation force is applied to the operation portion 51 on the side (down direction in the drawing) of one maximum surface of the cartridge case 6 with an agitation mechanism (not illustrated) from a still state in FIG. 3A. Then, referring to FIG. 3B, the agitation portion 53 is moved to one surface side (up direction in the drawing) of the ink storage bag 3 with the agitation-member welding portion 52 as the fulcrum point. An end 53*a* of the agitation portion 53 is abutted to the ink storage bag 3.

Figure 3C:
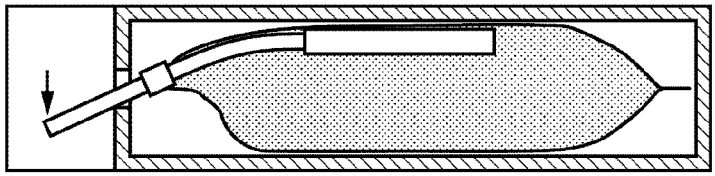
Figure 3D:
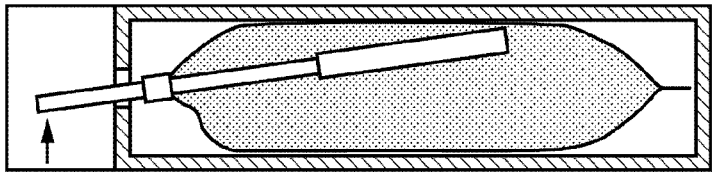
Figure 3E:
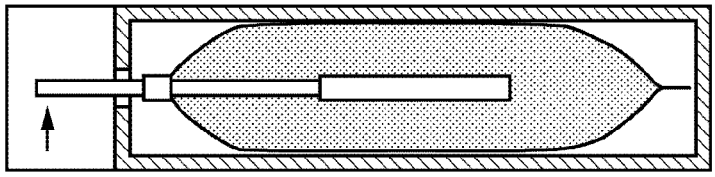
Figure 3F:
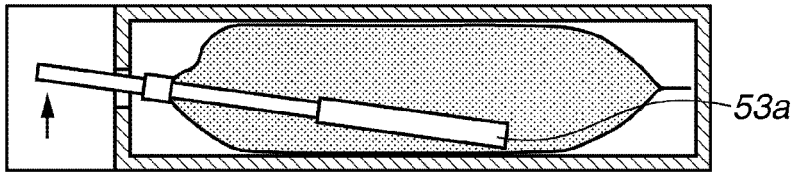
Figure 3G:
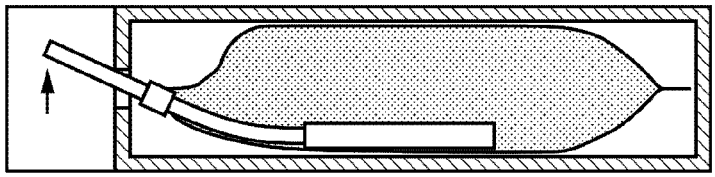
Figure 4A:
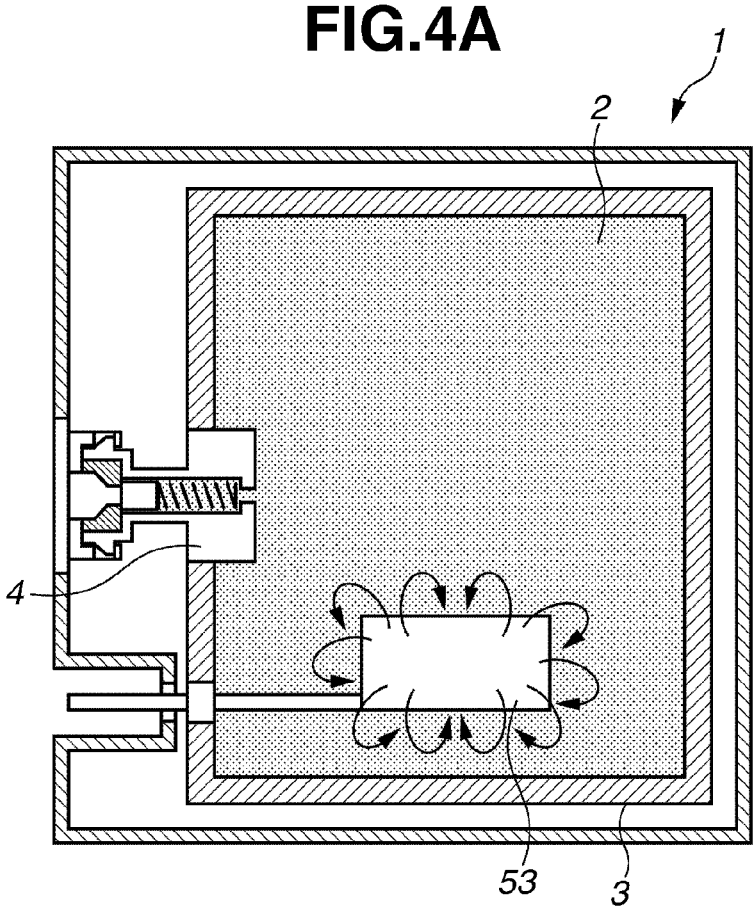
FIGS. 4A to 4C illustrate flows of ink agitated in the state of the agitation member in FIG. 3C.
Figure 4B:
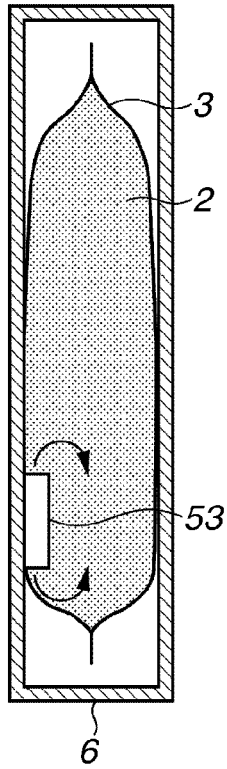
Figure 4C:
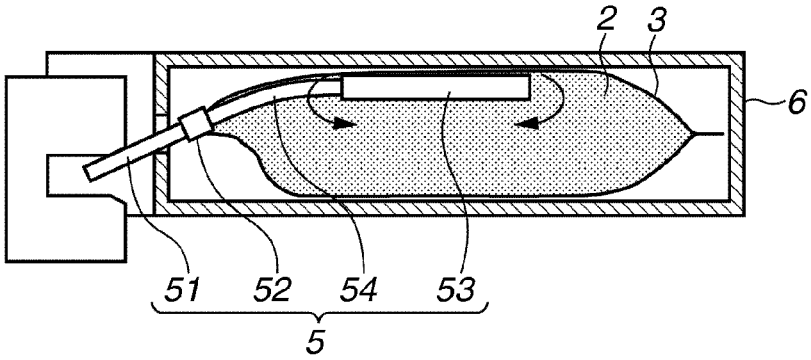

Further, operation force is applied in the same direction. Then, referring to FIG. 3C, the transmission unit 54 is bent and the entire surface of the agitation portion 53 is abutted to the inner surface of the ink storage bag 3. As a consequence, the ink 2 located in an area sandwiched between the agitation portion 53 and the inner surface of the ink storage bag 3 in FIG. 3A is pushed out around the agitation portion 53. An ink flow is generated, and the ink 2 in the ink storage bag 3 is agitated. FIGS. 4A to 4C illustrate states of the agitation member 5 illustrated in FIG. 3C in which arrows indicate flows of the ink 2 agitated by the agitation portion 53.

The operation portion 51 is operated (moved) to the other maximum surface side (in the upward direction in the drawing) of the cartridge case 6. Then, referring to FIGS. 3D, 3E, and 3F, the agitation portion 53 is moved to another surface side (in the downward direction in the drawing) of the ink storage bag 3 with the agitation-member welding portion 52 as the fulcrum point. The end portion 53*a* of the agitation portion 53 is abutted to the inner surface of the ink storage bag 3.

The operation still continues. Then, referring to FIG. 3G, the transmission unit 54 is bent in the opposite direction of the state in FIG. 3C. The entire surface of the agitation portion 53 corresponding to the opposite side of the abutment surface illustrated in FIG. 3C is abutted to the inner surface of the ink storage bag 3. At this time, the ink 2 between the agitation portion 53 and the inner surface of the ink storage bag 3 is pushed out around the agitation portion 53, thereby generating flows of ink (similar to the arrows in FIGS. 4A to 4C). Thus, the ink 2 in the ink storage bag 3 is agitated.

Figure 3H:
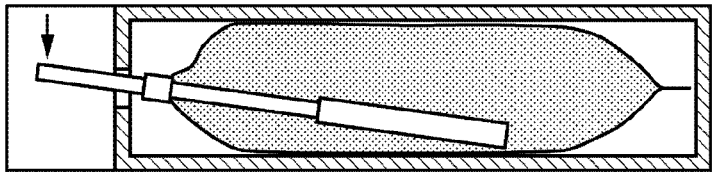

Referring to FIG. 3H, the operation portion 51 is operated in the same direction (in the downward direction in the drawing) as the operating direction illustrated in FIG. 3A. Then, the agitation portion 53 is moved toward the center (medium position between the films forming the ink storage bag 3) in the ink storage bag 3, and is returned to the position illustrated in FIG. 3A.

As described above, by repeating the operations in FIGS. 3A to 3H, the ink 2 in the ink storage bag 3 is agitated.

The operation of the agitation member 5 in an ink cartridge 1 from which some of the ink 2 has been consumed, will be described.

Figure 5A:
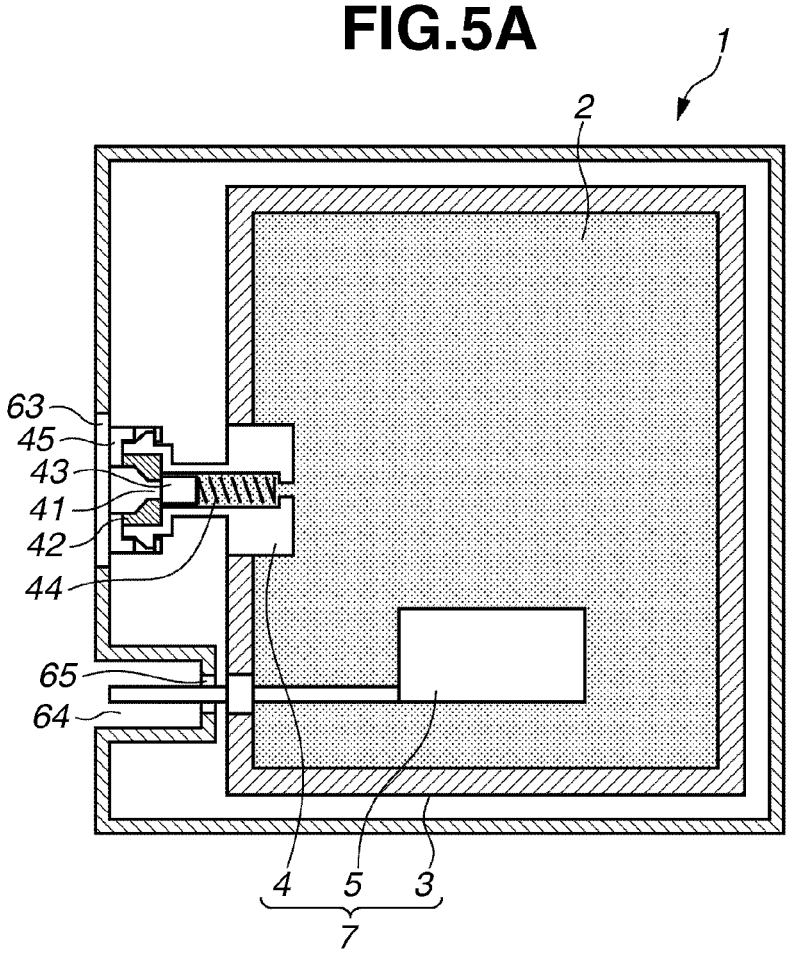
FIGS. 5A to 5C is schematic diagrams illustrating the ink cartridge when half of full ink is consumed.
Figure 5B:
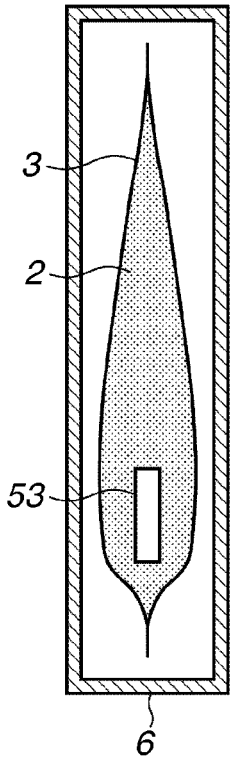
Figure 5C:
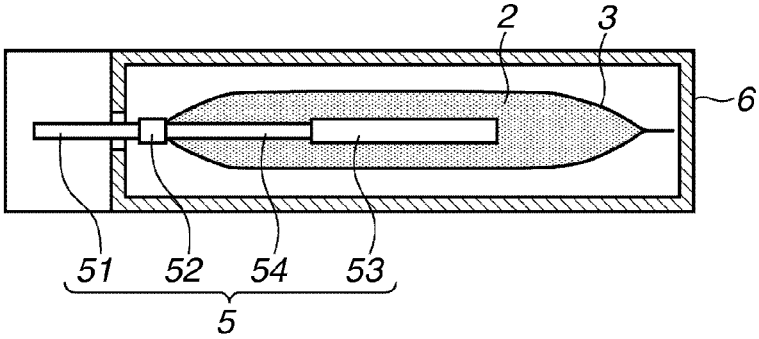
Figure 6A:
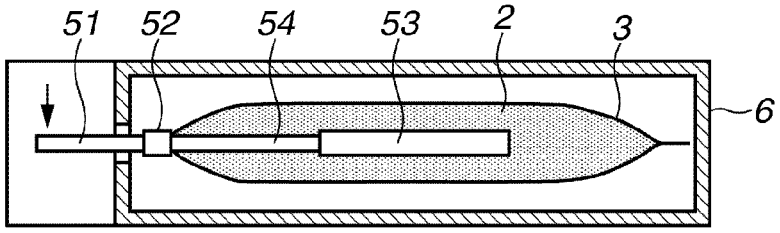
FIGS. 6A to 6H are cross-sectional views sequentially illustrating states of operating the agitation member viewed in the cross-sectional view in FIG. 5C.
Figure 6B:
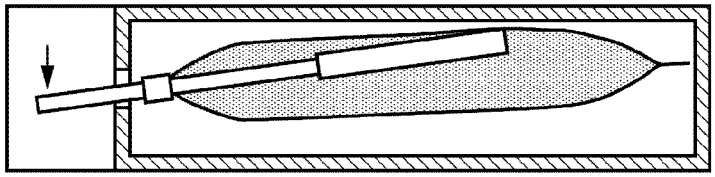
Figure 6C:
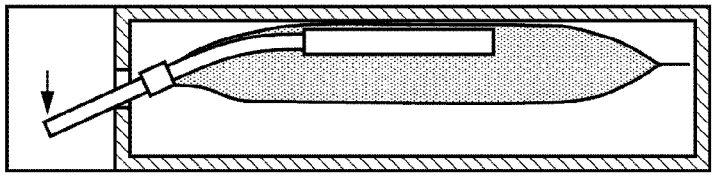
Figure 6D:
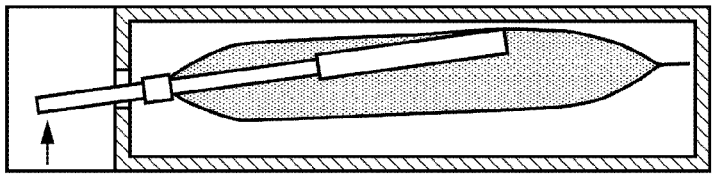
Figure 6E:
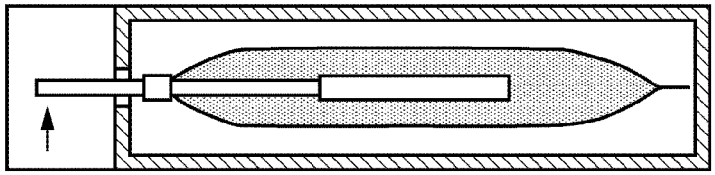
Figure 6F:
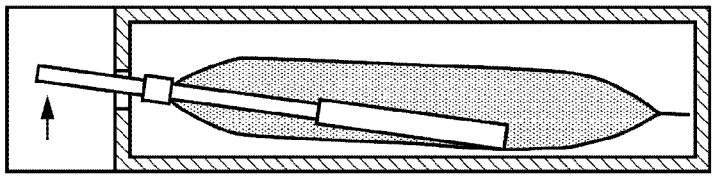
Figure 6G:
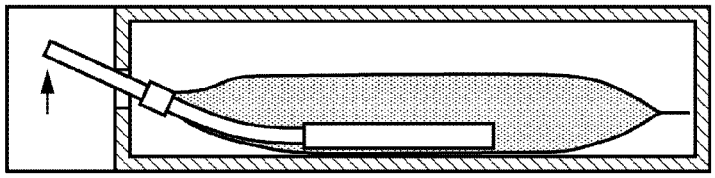
Figure 6H:
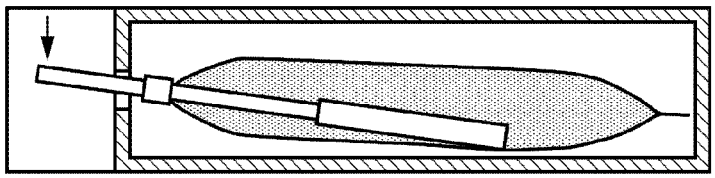

FIGS. 5A to 5C are schematic diagrams illustrating the ink cartridge 1 in which ½ of full ink (so half of the total ink) has been consumed in states of the ink cartridge 1 viewed in the same cross-sections as those illustrated in FIGS. 1A to 1C. In particular, FIG. 5A is a cross-section viewed from the lateral side of the ink cartridge 1 in an attitude of the ink cartridge 1 being attached to an ink cartridge attachment portion of the printer. FIGS. 6A to 6H sequentially illustrate states of operating the agitation member 5 in the cross-section illustrated in FIG. 5C. Arrows near the operation portion 51 in the agitation member 5 in FIGS. 6A to 6H illustrate operation directions of the operation portion 51.

Referring to FIGS. 5A to 5C, in the attitude of the ink cartridge 1 being attached to the printer, when the ink 2 in the ink storage bag 3 is consumed and the ink storage bag 3 is dented to be flat (becomes flattened, e.g. by application of external pressure such as by application of compressed gas to the interior of the case 6), a space is produced between the side wall of the cartridge case 6 and the ink storage bag 3.

With agitation operation in this state, the ink storage bag 3 is deformed by the agitation portion 53 that is abutted to the inner surface of the ink storage bag 3, and the ink storage bag is moved together with the agitation portion 53. Further, the ink storage bag 3 is abutted to the inner surface of the side wall having the maximum area of the cartridge case 6 (refer to FIGS. 6A to 6C). With the operation in the opposite direction, similarly, the ink storage bag 3 is deformed and is abutted to the inner surface of the side wall having the maximum area of the cartridge case 6 by the agitation portion 53 (refer to FIGS. 6D to 6G).

The side of the ink storage bag, facing the side on which the agitation-member welding portion 52 is arranged, is not held to any sides, i.e., is a free end. Thus, the ink storage bag 3 is deformed with the operation of the agitation member 5, and is moved, following the movement of the agitation portion 53. That is, unlike the conventional configuration discussed in Japanese Patent Application Laid-Open No. 2005-66520, in which an ink supply unit and an agitation member are oppositely positioned, the movement of the agitation portion 53 is not limited, even when some of the ink 2 has been consumed, so the ink can still be effectively agitated.

Figure 7A:
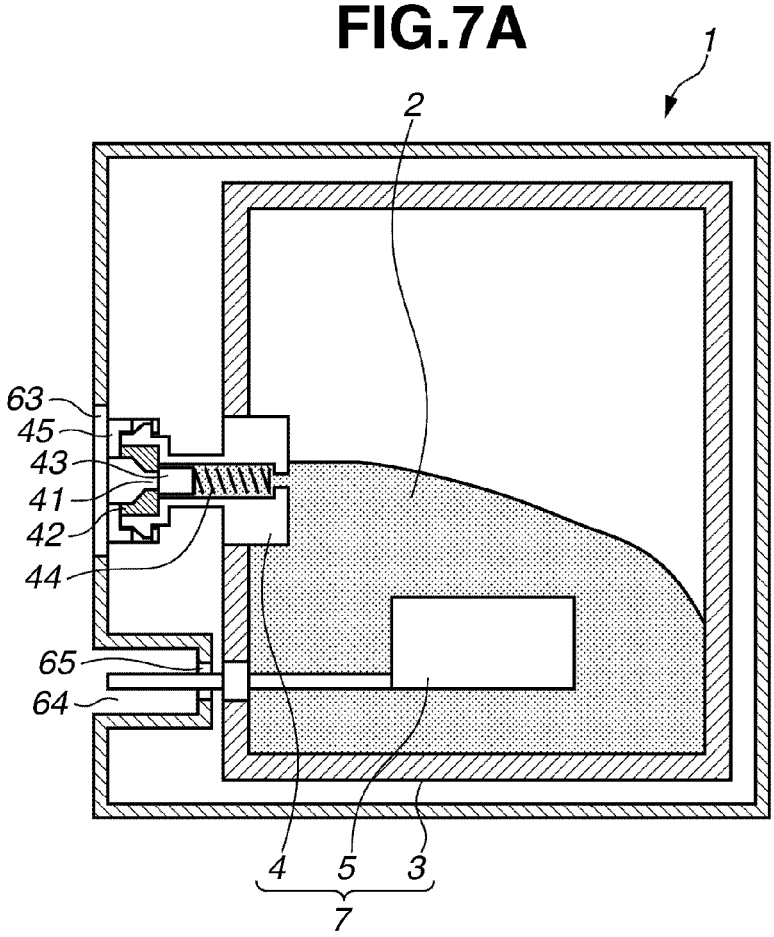
FIGS. 7A to 7C are schematic diagrams illustrating the ink cartridge when the ink is further consumed from the states in FIGS. 6A to 6H.
Figure 7B:
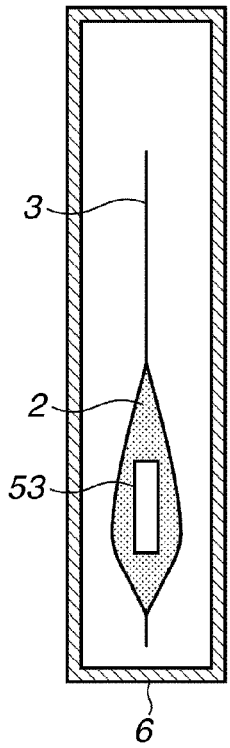
Figure 7C:
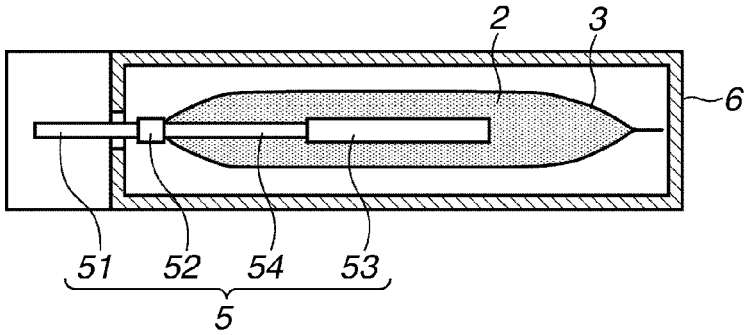

FIGS. 7A to 7C are schematic diagrams illustrating the ink cartridge 1 in which the ink 2 is consumed from the state illustrated in FIGS. 6A to 6H. Further, FIGS. 7A to 7C illustrate states in the ink cartridge 1 in the same cross-sections as those illustrated in FIGS. 1A to 1C. In particular, FIG. 7A is the cross-section viewed from the ink cartridge 1 on the lateral side in the attitude of the ink cartridge 1 being attached to the ink cartridge attachment portion of the printer.

Referring to FIGS. 7A to 7C, more ink 2 has been consumed from the amounts of ink 2 illustrated in FIGS. 6A to 6H (e.g., ¼ of the full ink is consumed). So the upper portion of the ink storage bag 3 is dented (has become flat) and the ink 2 exists only in the lower portion of the ink storage bag 3.

The agitation member 5 is arranged in the area which still contains the ink 2, so is arranged in the lower portion of the ink storage bag below the spout 4. In this state, similarly, the ink storage bag 3 is also deformed and is moved together with the agitation portion 53.

Therefore, referring to FIG. 7B, even if the consumption of the ink 2 results in denting (deforming or flattening of) the upper portion of the ink storage bag 3, the ink 2 can be agitated.

According to the present exemplary embodiment, the precipitated ink can be agitated, irrespective of the consumption state of the ink 2.

More specifically, advantages of the present exemplary embodiment will be described below.

As described above, the spout 4 and the agitation member 5 are attached to the same edge of the ink storage bag 3. Thus the side of the ink storage bag 3, opposite to the side on which the spout 4 and the agitation member 5 are arranged, is a free end. The ink storage bag 3 can be moved with the operation of the agitation member 5 (so can be moved by the agitation member). In particular, when the amount of the ink 2 in the ink storage bag 3 is small, an agitation advantage obtained by moving (operating) the ink storage bag 3 can be expected in addition to the agitation advantage of the agitation member 5.

The spout 4 and the agitation member 5 are attached to one edge of the ink storage bag 3. Simultaneous attachment is consequently possible and a manufacturing process can be simplified. Since the spout 4 and the agitation member 5 are attached to the same edge of the ink storage bag 3, a number of distorted portions on the film of the ink storage bag 3 is reduced. Further, the possibility is reduced for leakage of the ink due to a welding defect of a film edge caused by crimps.

As will be described below, when the ink cartridge 1 is attached to a cartridge holder of the printer (refer to FIG. 10), a drive mechanism of the agitation member 5 can be arranged at a back end 103*c* of the cartridge holder, similar to the setting place of the ink supply unit for supplying the ink to an inkjet recording head on the main body side of the printer from the attached ink cartridge 1. As a consequence, the size of the printer configuration can be reduced.

A preferable configuration of the ink cartridge 1 according to the present exemplary embodiment will be described.

Representatively, referring to FIGS. 2A to 2C, the spout 4 and the agitation member 5 are welded to the edge of the same side of the ink storage bag 3. The circumference of the welded two films forming the ink storage bag 3 has high rigidity and is not easily deformed.

The spout 4 welded to the ink storage bag 3 is fixed to the cartridge case 6 at a fixing portion (not illustrated). The agitation member 5 is welded to the edge of the ink storage bag 3 which is not easily deformed. However, the agitation member 5 is not fixed to the cartridge case 6, and the operation portion 51 is extended to the outside of the cartridge case 6 through the opening 5.

Therefore, in the agitation member 5, the operation portion 51 and the agitation portion 53 are movable in opposite phases by setting the agitation-member welding portion 52 as the fulcrum point. Strictly, the agitation member 5 is operated while twisting the agitation-member welding portion 52, with a welding portion (hereinafter, referred to as a spout welding portion) as the fulcrum point to the ink storage bag 3 of the fixed spout 4.

When the position of the spout welding portion is too close to the agitation-member welding portion 52, the operation is interfered (interference may occur). Hence a distance A, between the spout welding portion and the agitation-member welding portion 52 (see FIG. 2A), is preferably set to be large enough to avoid such interference.

Figure 8:
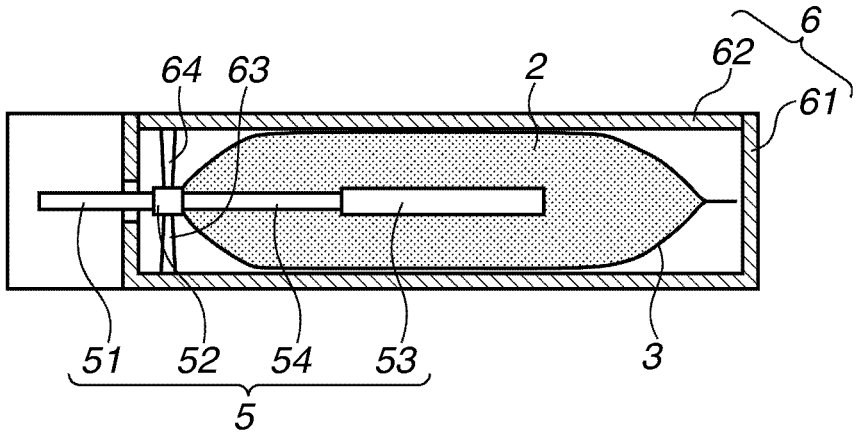
FIG. 8 is a schematic diagram illustrating another configuration of the ink cartridge according to an exemplary embodiment of the present invention.

As another configuration, referring to FIG. 8, ribs 63 and 64 are preferably disposed in the cartridge case 6 to hold the agitation-member welding portion 52. Specifically, when the ink storage bag 3 is enclosed in the cartridge case 6, the ribs 63 and 64 are preferably disposed on the cartridge case 61 and the cartridge cover 62 to sandwich the agitation-member welding portion 52 from both sides and hold it.

With this configuration, the agitation-member welding portion 52 becomes a fulcrum point at which positional deviation is not caused when operating the agitation member 5. As a consequence, the agitation operation can be performed more stably.

Further, as another configuration, when the ink is filled in the ink storage bag 3 and the agitation member 5 is operated, a position H of the agitation member 5 with respect to the bottom surface of the ink storage bag 3 is preferably set at a distance B (refer to FIGS. 2A to 2C) from a lower portion of the ink storage bag 3 so that the agitation portion 53 can be abutted to the inner surface of the ink storage bag 3.

In order to agitate the precipitated ink effectively, in the attitude of the ink cartridge 1 being used in the printer, the agitation portion 53 is preferably arranged near the bottom portion of the ink storage bag 3. Representatively, referring to FIGS. 2A to 2C, an inclined portion 3*a* is formed by the ink 2 filled in the ink storage bag 3 inclining from the outer circumference of the ink storage bag 3 to the center portion.

Thus, if the agitation portion 53 is excessively close to the bottom portion of the ink storage bag 3, when operating the agitation member 5, the agitation member 5 cannot be moved at the position where the lower portion of the agitation portion 53 is abutted to the inclined portion 3*a* of the ink storage bag 3. As a consequence, it is not possible to push the ink 2 out around, and generate a large flow thereof (a flow of ink similar to the arrow in FIGS. 4A to 4C) by abutting the entire surface of the agitation portion 53 to the inner surface of the ink storage bag 3.

The entire surface of the agitation portion 53 is desirably arranged near the bottom portion of the ink storage bag 3 within a range in which the entire surface of the agitation portion 53 can be abutted to the inner surface of the ink storage bag 3.

Figure 9:
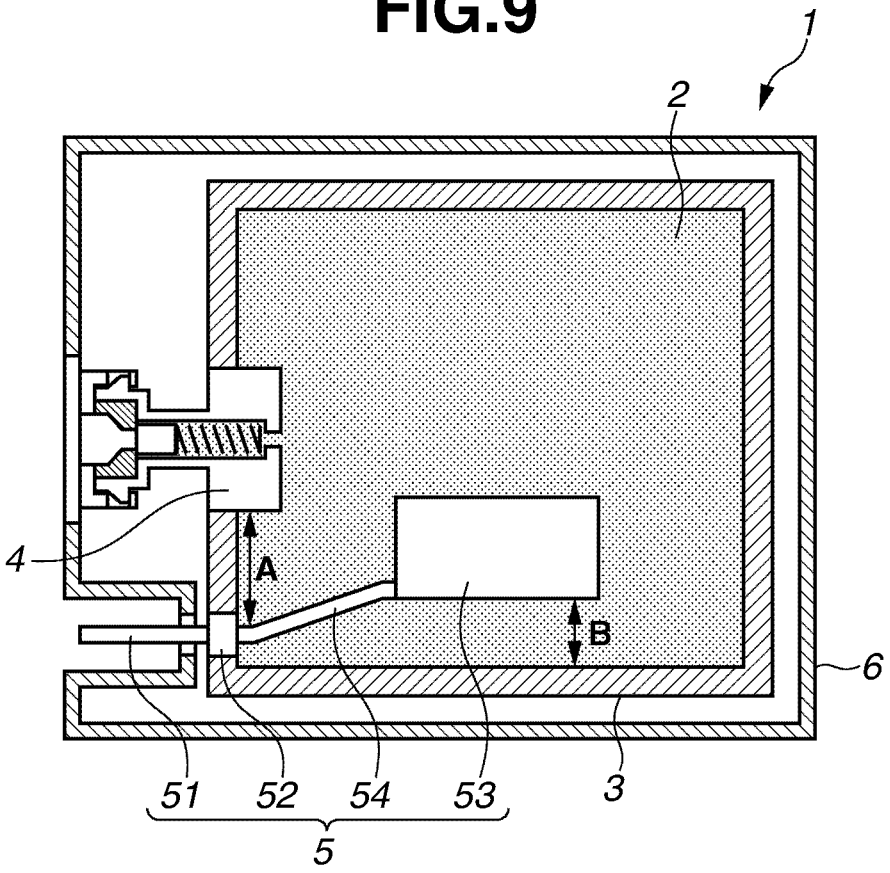
FIG. 9 is a schematic diagram illustrating another configuration of the ink cartridge according to an exemplary embodiment of the present invention.

However, when the ink storage bag 3 is relatively small, the agitation portion 53 cannot be arranged at a certain distance from the bottom portion of the ink storage bag 3 while maintaining a sufficient distance A between the spout welding portion and the agitation-member welding portion 52. In this case, referring to FIG. 9, the transmission unit 54 of the agitation member 5 is bent (inclined), thereby enabling both the distances A and B to be made appropriate. As a result, the ink 2 can be agitated, irrespective of the ink consumption state.

"Usage Example of Ink Cartridge 1"

Figure 10:
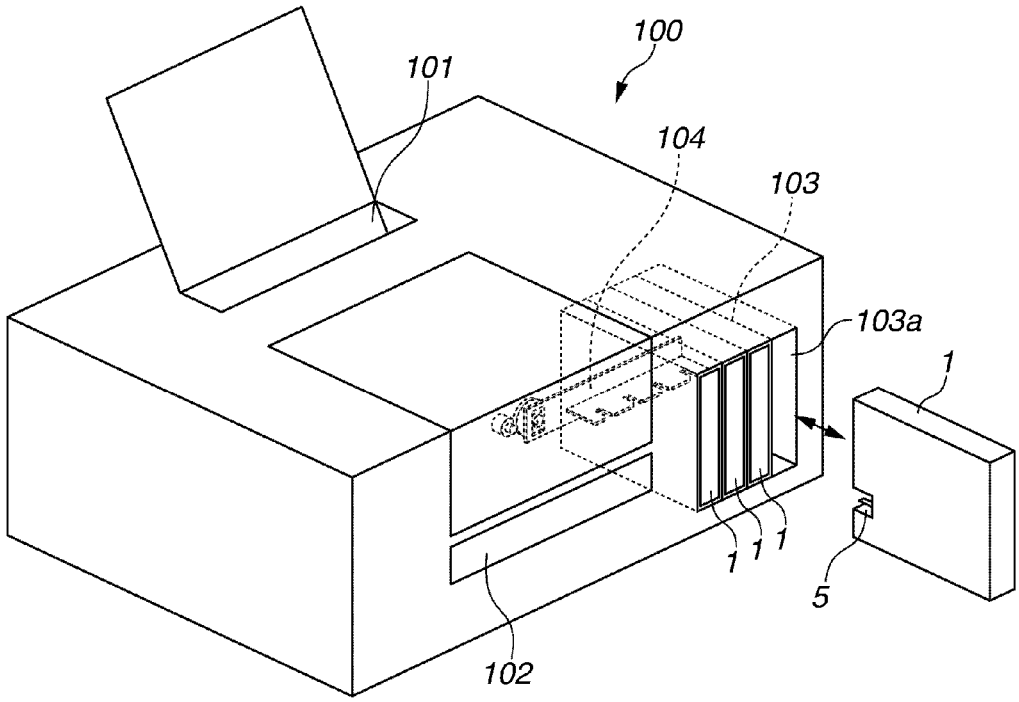
FIG. 10 is a schematic diagram illustrating a configuration of a printer to which the ink cartridge is applied according to an exemplary embodiment of the present invention.

FIG. 10 is a schematic diagram illustrating a configuration of a printer to which the above-mentioned ink cartridge 1 is applied.

The printer includes a carriage (not illustrated) to which a recording head of an inkjet recording system is detachable, and a conveyance unit (not illustrated) that conveys a recording sheet on which an image is recorded with ink droplets discharged from the recording head. In addition to the configuration, a printer 100 in FIG. 10 includes a sheet feeding entrance 101 for feeding the recording sheet to an image recording area with the recording head and a discharge port 102 for discharging the recording sheet on which an image is recorded.

The discharge port 102 has an opening on the front surface of a casing of the printer 100. Further, the printer 100 has a cartridge holder 103, as an ink cartridge attachment portion, to which the ink cartridge 1 according to the present exemplary embodiment of the invention containing the ink to be supplied to the recording head is releasably attachable and detachable. An attachment port 103*a* giving access to the cartridge holder 103 is opened on the front surface of the casing of the printer 100.

The cartridge holder 103 enables the ink cartridge 1 to be attached into the printer 100 in the attitude (or orientation) illustrated in FIG. 10. Therefore, the ink cartridge 1 attached to the cartridge holder 103 is disposed with a side surface of the cartridge case 6, having an opened ink supply port, and the side surface with the maximum area of the cartridge case 6 being mutually orthogonal and orthogonal to the bottom surface of the printer 100.

Further, the printer 100 is usually placed on a horizontal surface such as a desk. Therefore when the printer is positioned horizontally the side surface of the cartridge case 6 having the opened ink supply port and the side surface with the maximum area of the cartridge case 6 are arranged in parallel with the gravity direction.

The ink cartridge 1 is attached through the attachment port 103*a* to the cartridge holder 103, and is attached to the cartridge holder 103 from the side, on which the ink supply port 41 formed with the spout 4 of the ink cartridge 1 and the operation portion 51 of the agitation member 5 are arranged.

A needle-shaped ink supply tube (not illustrated) is disposed at the back of the cartridge holder 103, as an ink supply unit, connected to a liquid chamber in the recording head via a connection tube. At the (end) time of attaching the ink cartridge 1, the ink supply tube enters the ink storage bag 3 via the ink supply port of the spout 4 of the ink cartridge 1. The ink 2 in the ink storage bag 3 can thereby be supplied to the recording head.

Further, a drive mechanism 104 for driving the agitation member 5 of the ink cartridge 1 is disposed at the back of the cartridge holder 103. An example of the agitation-member drive mechanism 104 is described with reference to FIGS. 11 and 12A to 12D.

Figure 11:
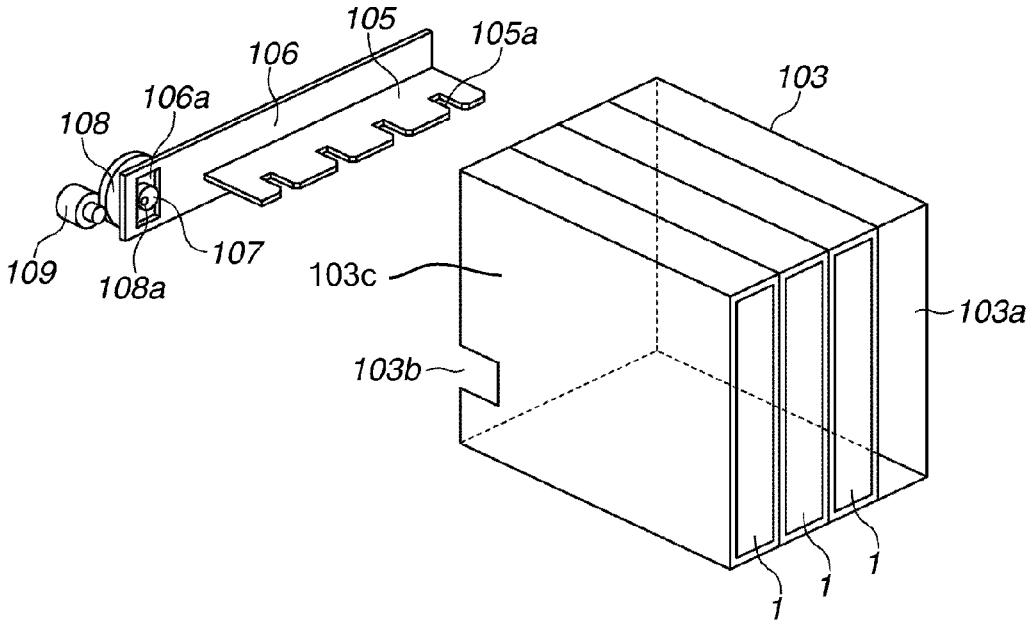
FIG. 11 is an exploded perspective view illustrating a configuration of an agitation-member drive mechanism illustrated in FIG. 10.
Figure 12A:
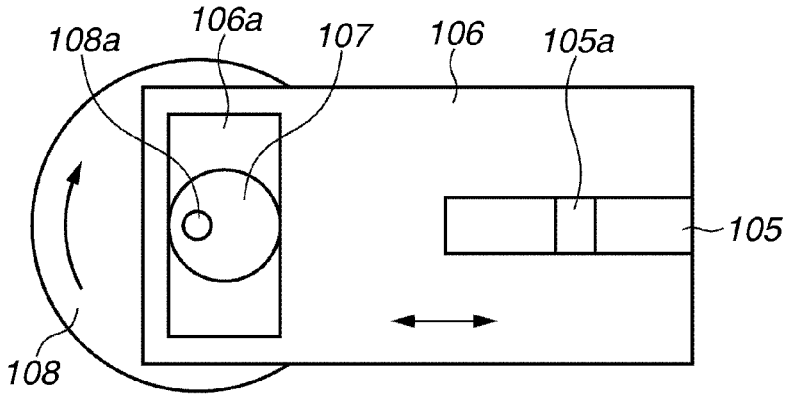
FIGS. 12A to 12D are schematic diagrams illustrating an operation of the agitation-member drive mechanism illustrated in FIG. 10.
Figure 12B:
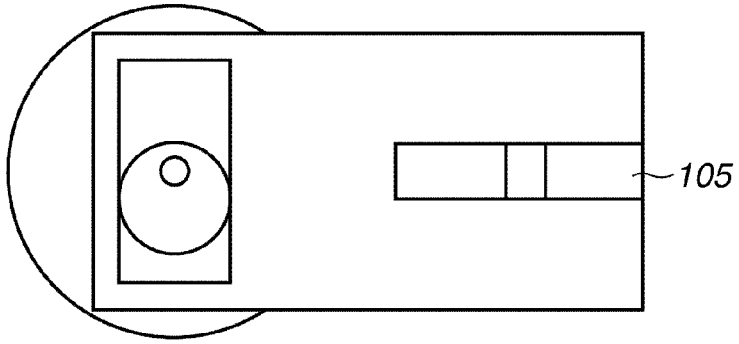
Figure 12C:
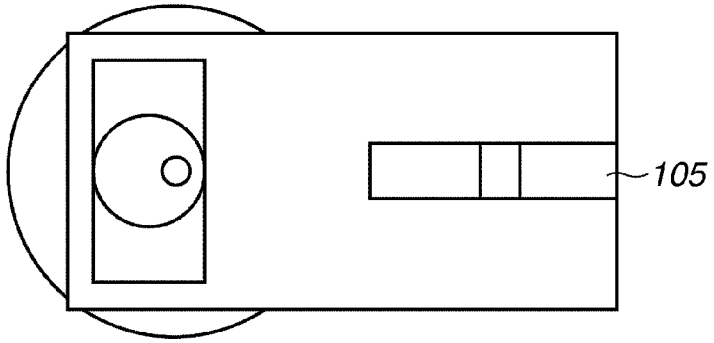
Figure 12D:
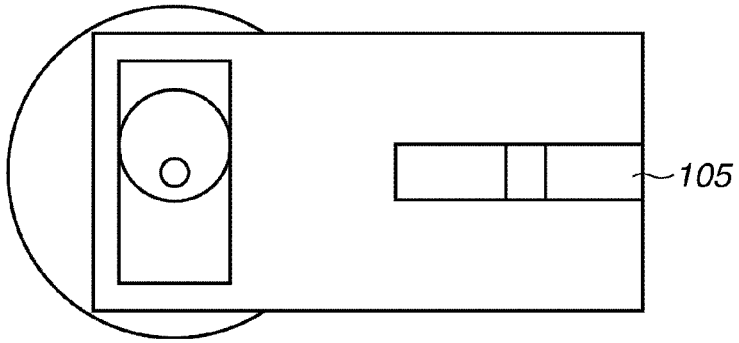

FIG. 11 is an exploded perspective view illustrating a configuration of the agitation-member drive mechanism 104. FIGS. 12A to 12D are schematic diagrams illustrating the operation of the agitation-member drive mechanism 104.

As illustrated in FIGS. 1 and 2A to 2C, an indented (concave) portion 64 is disposed to the side surface having the opened ink supply port of the cartridge case 6. The operation portion 51 of the agitation member 5 is projected in the concave portion 64. A notch 103*b* is formed in the cartridge holder 103, corresponding to the concave portion 64 of the ink cartridge 1 attached to the cartridge holder 103.

A plurality of the cartridge holders 103 are arranged in parallel to attach a plurality of the ink cartridges 1 to the printer, as illustrated in FIG. 11. A plate-shaped drive member 105 is horizontally arranged, passing through the notches 103*b* of all the cartridge holders 103.

The drive member 105 can be engaged with the operation portion 51 in the concave portion 64 of the ink cartridge 1 completely attached to the back of the cartridge holders 103. Since the operation portion 51 is bar-shaped, the drive member 105 includes a groove 105*a* that is fit thereto.

When the ink cartridge 1 is attached to the cartridge holder 103, the operation portion 51 of the agitation member 5 in the ink cartridge 1 is fitted into the groove 105*a* of the drive member 105. Therefore, by reciprocating the drive member 105 in the horizontal direction (of the printer setting surface), the operation portion 51 is also driven, thereby generating a flow of the ink in the ink storage bag 3 with the agitation portion 53.

Although a device for reciprocating the plate-shaped drive member 105 may have any well-known configuration, as an example, there is a device for converting rotation movement into reciprocating linear movement in the examples in FIGS. 11 and 12A to 12D. In FIGS. 11 and 12A to 12D, a fixing plate 106 fixes the drive member 105, and a rectangular opening 106*a* is provided at an end of the fixing plate 106.

Both long sides of the rectangular opening 106*a* in the short direction contact slidingly with the circumferential surface of a circular cam 107. The circular cam 107 is eccentrically attached to a rotational shaft 108*a* as the center of a gear 108. The gear 108 is engaged with a rotational shaft of a motor 109. With this configuration, referring to FIGS. 12A to 12D, the gear 108 is rotated clockwise with the motor 109, thereby reciprocating the drive member 105 together with the fixing plate 106 in the horizontal direction. Obviously, the configuration is an example and the present invention is not limited to this.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-117252 filed May 21, 2010, which is hereby incorporated by reference herein in its entirety.

What is claimed is:

1. An ink cartridge comprising: a flexible ink storage bag;
a spout for ink supply attached to the ink storage bag;
an agitation member attached to the ink storage bag; and
a case containing the ink storage bag, wherein the agitation member includes an agitation portion, arranged in the ink storage bag and configured to agitate ink, and an operation portion, connected to the agitation portion, positioned outside the ink storage bag and configured to operate the agitation portion,
wherein the spout and the operation portion are arranged on a same side of the case, and wherein the spout and the agitation portion are both fixed at different locations to a same edge of the ink storage bag, and
wherein the agitation member is arranged to swing an end of the ink storage bag.

2. The ink cartridge according to claim 1, wherein only one end of the ink storage bag is fixed to the case.

3. The ink cartridge according to claim 2, wherein the agitation portion is arranged to press the ink storage bag against at least one side of the case.

4. A printer comprising:

a recording head; and an ink cartridge attachment portion, to which an ink cartridge can be detachably attached, extending from an opening to a back end, the ink cartridge attachment portion comprising an agitation-member drive unit configured to engage with and drive an agitation member of such an attached ink cartridge, wherein a fixed spout, arranged on the ink cartridge, and the agitation-member drive unit are both arranged at the back end of the ink cartridge attachment portion when the ink cartridge is engaged with the ink cartridge attachment portion, and wherein the fixed spout is welded to an ink storage bag and the weld is a fulcrum for the ink storage bag and the fixed spout, and wherein, when the agitation member operated by the agitation-member drive mechanism agitates the ink, a free end of the ink storage bag is swingingly moved.

5. The printer according to claim 4, wherein the agitation-member drive unit is positioned below the fixed spout.

6. The printer comprising one or more ink cartridges according to claim 4, attached to the ink cartridge attachment portion such that the agitation member is engaged with the agitation-member drive unit.

* * * * *